United States Patent [19]

Ballas

[11] Patent Number: 5,010,928

[45] Date of Patent: Apr. 30, 1991

[54] REPRESSURIZER FOR CARBONATED DRINK CONTAINERS

[76] Inventor: Mitchell J. Ballas, 925 Nixon Ave., Indiana, Pa. 15701

[21] Appl. No.: 552,309

[22] Filed: Jul. 13, 1990

[51] Int. Cl.[5] ..... B65B 31/00; B65B 1/04; B65D 39/00

[52] U.S. Cl. ..... 141/64; 141/363; 215/228

[58] Field of Search ..... 141/18, 21, 25, 26, 141/46, 64, 63, 197, 363, 366, 346, 66; 215/228, 260, 316, 319; 220/287

[56] References Cited

U.S. PATENT DOCUMENTS

| | | | |
|---|---|---|---|
| 4,033,091 | 7/1977 | Saponara | 53/88 |
| 4,453,544 | 6/1984 | Silverthorn | 128/206.17 |
| 4,768,665 | 9/1988 | Ballas | 215/228 |
| 4,838,324 | 6/1989 | Boyd | 141/64 |

*Primary Examiner*—Henry J. Recla
*Assistant Examiner*—Antoine A. Gamarra
*Attorney, Agent, or Firm*—William J. Ruano

[57] ABSTRACT

A repressurizer for carbonated drink bottles. It comprises an internally threaded cap having a one-way valve for screwing onto the threads of a bottle neck. The pump has fastening wings for detachable attachment to the bottom of a vertically extending pump. The pump has a bottom gasket for making an air-tight seal with the cap.

A modification is to eliminate the fastening wings and have the pump slip fitted or screw threaded to the cap. A still further modification is to reduce the top diameter of the cap and provide threads that can be screwed onto a bicycle or automobile pump.

1 Claim, 3 Drawing Sheets

REPRESSURIZER FOR CARBONATED DRINK CONTAINERS

This invention relates to the preservation of the carbonation in soft drinks and is an improvement over my U.S. Pat. No. 4,768,665 dated Sept. 6, 1988.

BACKGROUND OF THE INVENTION

Before the advent of plastic containers, the amount of soft drink in a typical glass bottle was twelve fluid ounces. This amount is one or two servings, and the contents were usually completely consumed upon opening the bottle. If the contents weren't completely consumed before it went flat, the amount wasted wasn't significant for anyone to complain about.

Two and three liter bottles of soft drink have the potential problem of wasting unacceptable amounts of beverage. When the bottle leaves the bottling plant, it is pressurized at about fifteen psi as a result of the carbonation process. Upon opening the bottle, this pressure is lost, and causes the beverage to begin fizzing. With the bottle recapped, fizzing continues until the fizzing action itself repressurizes the bottle again to fifteen psi. The concentration of beverage carbonation decreases then, each time this process is repeated.

The loss of pressure above the liquid is what triggers the fizzing. Systems exist today to restore this pressure using canisters of compressed carbon dioxide. There is no system setup for the disposable plastic bottles and $CO_2$ canisters.

SUMMARY OF THE INVENTION

The invention relates to a bottlecap such as one having a screw threaded top, which bottle cap embodies an air pump. The air pump may take various forms. The pump extends vertically upwardly from the bottle cap to which it it detachably fitted so that pressure may be more easily applied. A threaded cap having a one-way valve and a rubber washer is provided which forms a tight fit with the bottom of an air pump.

DESCRIPTION OF THE PREFERRED EMBODIMENTS

Figure 1:
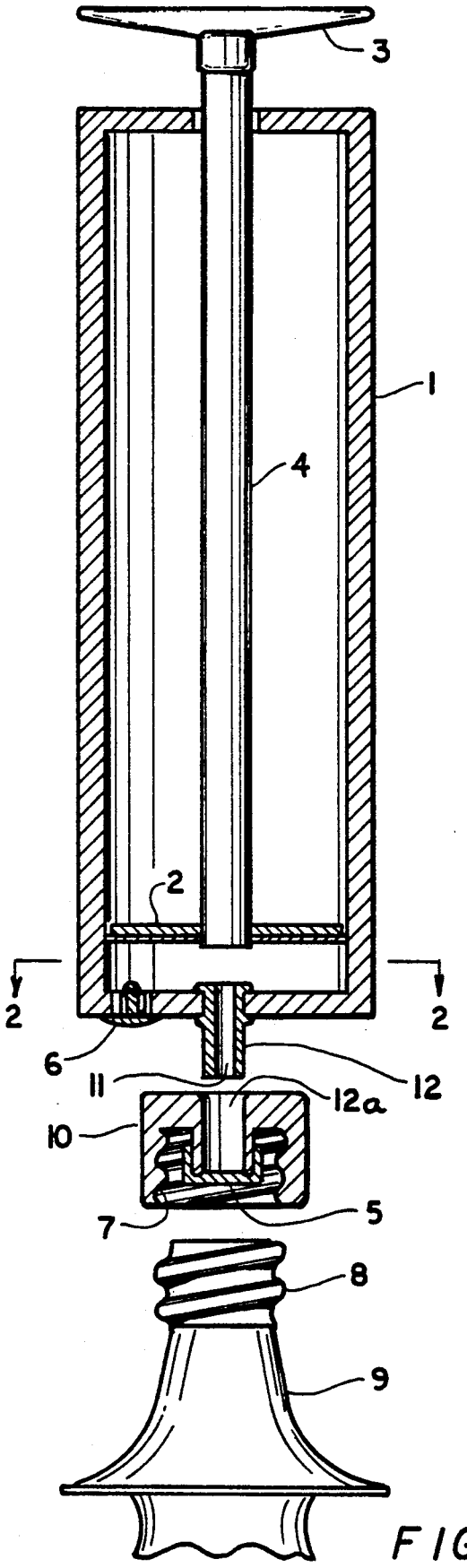
FIG. 1 is an exploded view of the bottle and pump combination of the present invention.
Figure 2:
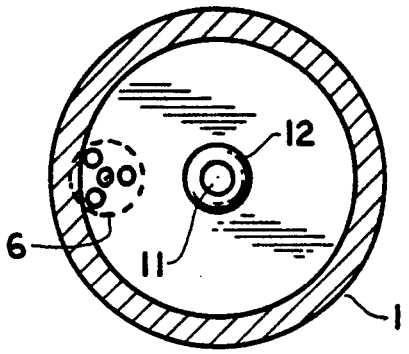
FIG. 2 is a cross-sectional view taken along line 2—2 of FIG. 1.
Figure 3:
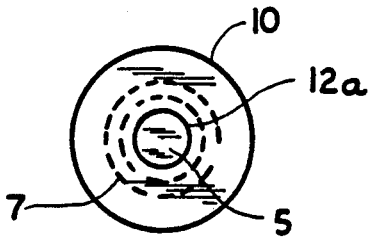
FIG. 3 is a top view of the one-way valve cap 10 shown in FIG. 1.
Figure 5:
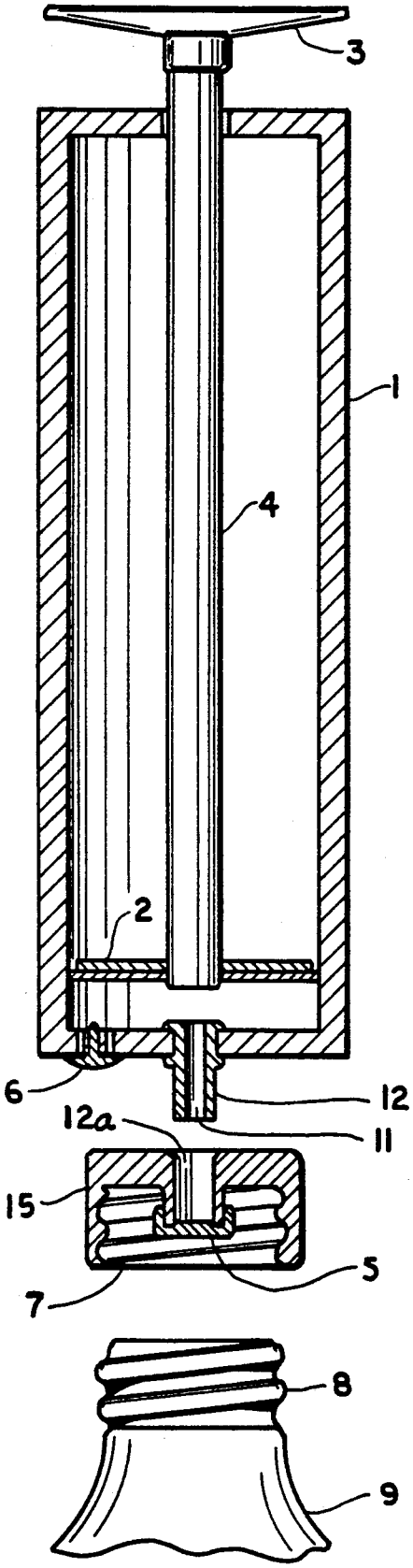
FIG. 5 is a view of another modification showing enlarged sizes of the parts to fit a bottle having a larger opening.

FIGS. 1, 2 and 3 show how this invention utilizes a small hand operated, air pump in 1 conjunction with a separate cap 10 to restore the pressure in a carbonated beverage bottle. The bottle 9, which is threaded at 8, is resealed, using the cap 10, which is internally threaded at 7 and which has a one-way rubber valve 5 at the top thereof.

The rubber male tube 12 is forced into the female tube **12*a* in the cap body. The fit between these two parts will be tight enough that the pump body does not cause 12 to slip back out of 12*a***. This will produce an airtight seal between the pump and the cap, as well as hold the pump in place for the act of pumping. A slight upward tug on the pump will pull the pump out of the cap for storage.

Figure 4:
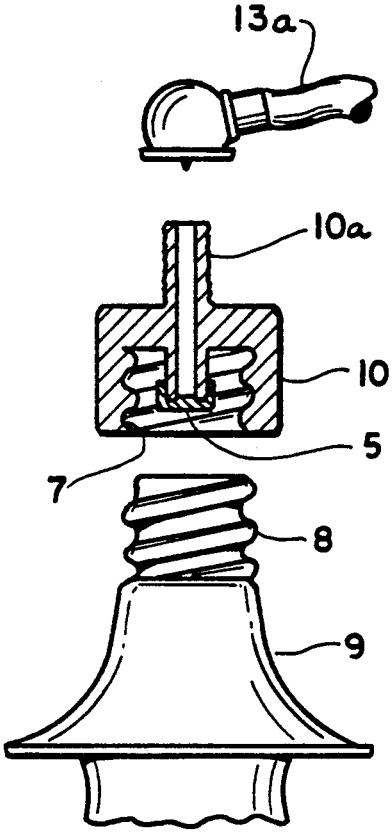
FIG. 4 is an exploded view of a modification of the invention.

FIG. 4 shows a modification using a bicycle or automobile pump, instead of pump 1, having a hose end **13*a* which is held against the outwardly threaded end 1O*a* of a one-way valve 10 screw threaded to threads 8 of the bottle 9**.

Figure 6:
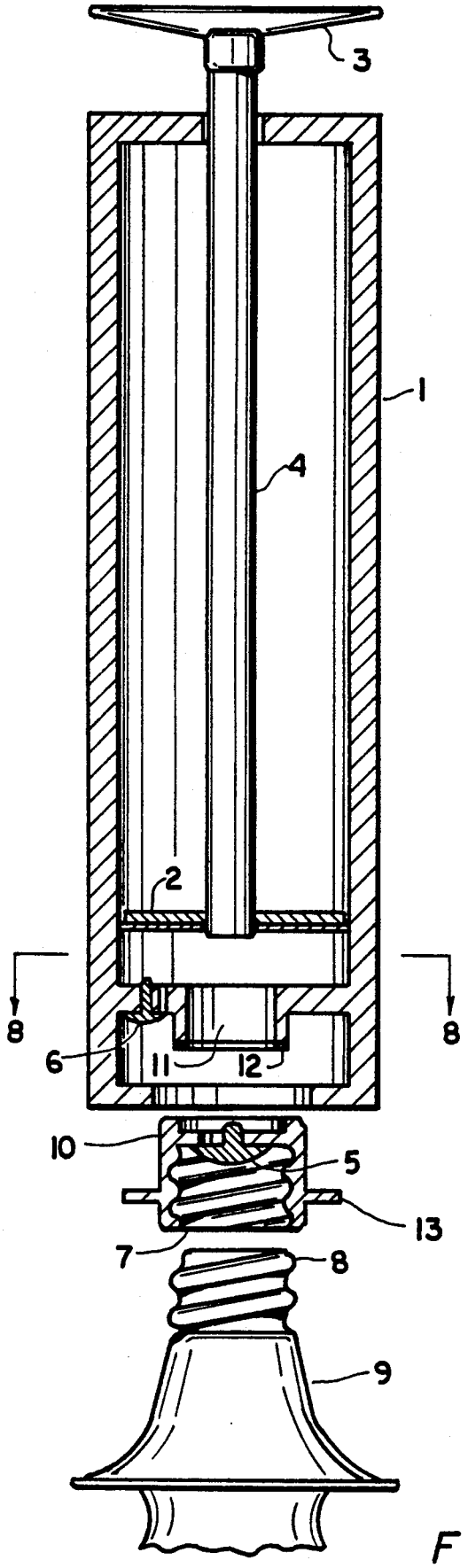
FIGS. 6, 7 and 8 show a still further modification involving a turn-to-lock method.
Figure 8:
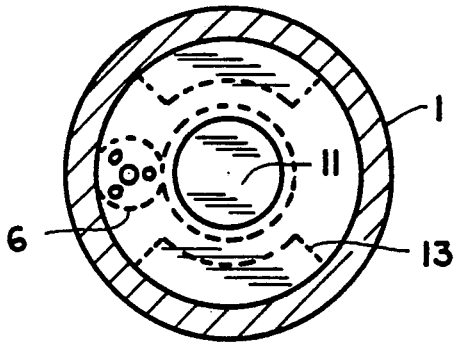
Figure 7:
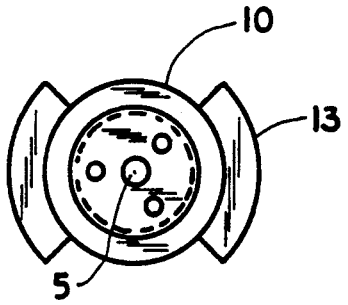

Referring to FIGS. 6, 7 and 8, the pump body 1 is then lowered down over the top of the cap 10 and locked mechanically thereto, by a turn-to-lock method using cam shaped wings 13 tightly fitted against the bottom of the cap body, as shown more clearly in FIG. 6. This locking action will detachably hold the cap and pump bodies together so as to maintain an air-tight seal between the two bodies during the act of pumping. The pump body has a rubber ring or gasket 12 to aid in producing the air-tight seal.

In operation, on the downstroke of handle 3, the plunger 2 pushes an amount of air through the orifice 11 in the pump body, and through or past the one-way or check valve 5 in the cap and into the top opening of bottle 9. On the upstroke, the pump cylinder refills with air from the atmosphere, readying the pump for the next downstroke. Valve 5 is a check valve which permits airflow in one direction only, downwardly into the bottle. The pressure regulator valve 6 also permits airflow in one direction only, from the pump cylinder out to the atmosphere. This valve will open only when the pressure in the pump cylinder exceeds a prescribed maximum valve, somewhere over fifteen psi. The pressure in the bottle starts out at atmospheric pressure. As the pressure is increased in the bottle, the force needed to pump the air into the bottle increases. When the pressure in the apparatus exceeds the prescribed value, the pressure regulator valve 6 opens, providing a new airflow path. This causes a decrease in required force felt in the handle of the pump. The handle "goes slack", letting the user know that the pumping can stop. The location of this pressure regulator valve could also be in the cap body instead of the pump body.

FIG. 4 shows a modification by providing external thread **10*a* on cap 10, an ordinary bicycle or automobile external thread 10*a* on cap 10, an ordinary bicycle or automobile tire pump 13*a* may be used instead of the pump having body 1, provided that said threads 10*a*** correspond to the size of the threaded fastening attachment at the end of the hose of said pump to which it will be screw-threadedly attached.

Since carbonated drinks come in bottles having different thread dimensions, as well as other types of tops, it is proposed to build individual caps to match those various designs for bottle tops. These different caps would have the ability to all mate up to, or be used in conjunction with, the same pump body. It would be possible also to build just one cap design, then build adaptors to enable the cap to be used on other sized or type of bottle top.

Thus it will be seen that I have provided a novel and highly efficient bottle cap and air pump assembly which is effective to maintain pressure on the liquid of a bottle.

While I have illustrated and described several embodiments of my invention, it will be understood that these are by way of illustration only and that various changes and modifications may be contemplated in my invention and within the scope of the following claims.

I claim:

1. For use in combination with a bottle having an externally threaded opening, a cap which is internally threaded to engage said externally threaded opening, said cap having a central tubular opening at the top thereof and a one-way valve at the bottom of said tubular opening, a hand operated air pump including a cylinder, a piston therein, a handle operatively connected to said piston and extending externally of said cylinder and a rubber air outlet tube connected to said cylinder and extending outwardly of said pump of a size to detachably fit snugly inside said central tubular opening of said cap in an air-tight manner, whereby said pump is useful for caps of different internal thread sizes for use on different bottle openings of corresponding thread sizes.

* * * * *